US008951135B1

(12) United States Patent
Guyer et al.

(10) Patent No.: US 8,951,135 B1
(45) Date of Patent: Feb. 10, 2015

(54) TABLETOP MINIATURE GOLF GAME

(76) Inventors: Reynolds W. Guyer, Boca Grande, FL (US); Kathryn D. Guyer, St. Paul, MN (US); Steven J. Huebl, Jordan, MN (US)

( * ) Notice: Subject to any disclaimer, the term of this patent is extended or adjusted under 35 U.S.C. 154(b) by 316 days.

(21) Appl. No.: 13/396,314

(22) Filed: Feb. 14, 2012

Related U.S. Application Data

(60) Provisional application No. 61/443,270, filed on Feb. 16, 2011.

(51) Int. Cl.
*A63B 67/02* (2006.01)
*A63B 69/36* (2006.01)

(52) U.S. Cl.
USPC ..... 473/153; 473/158; 473/160; 473/162; 473/172

(58) Field of Classification Search
CPC ..... A63F 7/0628; A63F 2007/3662; A63B 67/02; A63B 69/3661; A63B 2210/50; A63B 2210/52; A63B 2210/54; A63B 69/3676
USPC ..... 473/157–164, 3, 10, 20, 171, 172, 173, 473/174, 197; 273/108.2–108.22, 127 R; D21/319
See application file for complete search history.

(56) References Cited

U.S. PATENT DOCUMENTS

| | | | | | |
|---|---|---|---|---|---|
| 1,548,291 | A | | 8/1925 | Van Arsdale, Jr. | |
| 1,582,237 | A | | 4/1926 | Angell | |
| 1,606,911 | A | | 11/1926 | Winbigler | |
| 1,679,374 | A | | 8/1928 | Reirden | |
| D82,533 | S | * | 11/1930 | Harris | D21/319 |
| 1,813,116 | A | * | 7/1931 | Clausen | 473/20 |
| 1,856,816 | A | | 5/1932 | Luddy | |
| 1,864,500 | A | | 6/1932 | Livingston et al. | |
| 1,875,198 | A | * | 8/1932 | Nagai | 473/20 |
| 2,176,622 | A | | 10/1939 | Davis | |
| 2,827,299 | A | * | 3/1958 | Dean | 473/158 |
| 2,944,816 | A | * | 7/1960 | Dixon | 473/435 |
| 2,995,372 | A | | 8/1961 | Hines | |
| 3,013,801 | A | * | 12/1961 | Kirkconnell, Jr. | 473/197 |
| 3,138,387 | A | * | 6/1964 | Miche et al. | 473/159 |
| 3,534,961 | A | * | 10/1970 | Tiley | 273/108.21 |
| 3,735,988 | A | * | 5/1973 | Palmer et al. | 473/162 |
| 3,801,101 | A | | 4/1974 | Greenberg | |
| 3,809,404 | A | * | 5/1974 | Fikse | 273/317.2 |
| 3,861,524 | A | | 1/1975 | Coleman | |
| 3,868,111 | A | | 2/1975 | Schuelke | |

(Continued)

OTHER PUBLICATIONS

"Sid Meier's SIM Golf" Video Game Box copy, 2 pages, dated prior to Jun. 6, 2001.

(Continued)

*Primary Examiner* — Sebastiano Passaniti
(74) *Attorney, Agent, or Firm* — James L. Young; Westman, Champlin & Koehler, P.A.

(57) ABSTRACT

In one aspect, an apparatus includes first and second end rails, a flexible rectangular playing surface, and first and second side rails. A first end edge of the surface is connected to the first end rail, and a second end edge of the surface is connected to the second end rail. The first and second side rails are configured for removable attachment to the first and second end rails. A method includes unrolling a flexible rectangular playing surface and attaching first and second side rails. Further, an apparatus comprises a rectangular playing surface, a rectangular raised perimeter border, and a plurality of golf course construction elements, wherein at least some of the elements comprise complementary curves so that the elements fit with each other.

12 Claims, 3 Drawing Sheets

(56) References Cited

U.S. PATENT DOCUMENTS

| | | | | | |
|---|---|---|---|---|---|
| 3,871,650 | A | * | 3/1975 | Casey | 273/108.21 |
| 3,892,405 | A | | 7/1975 | Trevino | |
| 3,897,067 | A | | 7/1975 | Smith | |
| 3,944,232 | A | | 3/1976 | Tierney | |
| 3,986,719 | A | * | 10/1976 | Lee | 473/197 |
| 3,990,573 | A | * | 11/1976 | Cross | 190/115 |
| 4,058,313 | A | | 11/1977 | Spradlin | |
| 4,098,507 | A | * | 7/1978 | Hudon | 273/108.21 |
| 4,124,210 | A | * | 11/1978 | Mason | 473/157 |
| 4,326,717 | A | * | 4/1982 | McClimon | 473/197 |
| 4,429,881 | A | | 2/1984 | Barrett | |
| 4,579,342 | A | * | 4/1986 | Mortensen | 473/3 |
| 4,596,391 | A | * | 6/1986 | Carolan, Jr. | 473/158 |
| 4,647,046 | A | * | 3/1987 | Hurt | 473/162 |
| 4,875,680 | A | * | 10/1989 | Gross | 273/108.21 |
| 4,877,250 | A | * | 10/1989 | Centafanti | 473/157 |
| 4,913,439 | A | * | 4/1990 | Ellington | 473/197 |
| 4,934,704 | A | * | 6/1990 | Mazer | 473/158 |
| 4,957,288 | A | * | 9/1990 | Kantner et al. | 473/3 |
| 5,042,813 | A | * | 8/1991 | Huang | 473/153 |
| 5,116,048 | A | | 5/1992 | Bilocerkowycz et al. | |
| 5,419,561 | A | | 5/1995 | Weber | |
| 5,580,319 | A | | 12/1996 | Hamilton | |
| 5,720,667 | A | * | 2/1998 | Tu | 473/162 |
| 5,749,789 | A | | 5/1998 | Karl | |
| 5,988,636 | A | | 11/1999 | Kilmer | |
| 6,152,830 | A | * | 11/2000 | Archie | 473/160 |
| 6,168,533 | B1 | * | 1/2001 | Camara | 473/3 |
| 6,367,797 | B1 | | 4/2002 | McKenna-Cress et al. | |
| 6,916,250 | B1 | | 7/2005 | Ricigliano | |
| 7,556,566 | B2 | | 7/2009 | Shin | |
| 2002/0169027 | A1 | | 11/2002 | Fowler | |

OTHER PUBLICATIONS

"Yolf" www.wikipedia.org entry, printed Nov. 9, 2010, 2 pages.
"Yolf Golf Game" merchandise information at www.flaghouse.com, printed Nov. 9, 2010, 1 page.
"Desktop mini golf game" merchandise information at www.gadgetsuk.com, printed Jan. 7, 2011, 1 page.

* cited by examiner

TABLETOP MINIATURE GOLF GAME

CROSS REFERENCE TO RELATED APPLICATION

This application claims the benefit of priority from U.S. Provisional Patent Application Ser. No. 61/443,270, filed Feb. 16, 2011 and entitled "Tabletop Miniature Golf Game," which is hereby incorporated by reference in its entirety.

BACKGROUND

Miniature golf is a game enjoyed by many players who appreciate the whimsy of a golf-like game that requires little skill and yet offers fun challenges. Drawbacks of conventional miniature golf settings include extensive space requirements, as each of the courses or holes is typically permanently installed and scaled so that players may walk on the course.

Thus, there is a need for a smaller-scale game apparatus that offers many of the same joys and challenges of miniature golf.

SUMMARY

In one aspect, an apparatus comprises first and second end rails, a flexible rectangular playing surface, and first and second side rails. The playing surface has first and second opposite end edges and first and second opposite side edges. The first end edge of the surface is connected to the first end rail, and the second end edge of the surface is connected to the second end rail. The first side rail is configured for removable attachment to the first and second end rails proximate the first side edge of the playing surface; and the second side rail is configured for removable attachment to the first and second end rails proximate the second side edge of the playing surface.

In another aspect, a method comprises unrolling a flexible rectangular playing surface from at least one of a first and second end rail to form a flat rectangular playing surface and attaching first and second side rails. The surface has first and second opposite end edges and first and second opposite side edges, wherein the first end edge of the surface is connected to the first end rail, wherein the second end edge of the surface is connected to the second end rail. The method comprises attaching a first side rail to the first and second end rails proximate the first side edge of the playing surface and attaching a second side rail to the first and second end rails proximate the second side edge of the playing surface.

In yet another aspect, an apparatus comprises a rectangular playing surface having first and second opposite end edges and first and second opposite side edges, a rectangular raised perimeter border disposed proximate the first and second opposite end edges and the first and second opposite side edges of the playing surface, and a plurality of golf course construction elements, wherein at least some of the elements comprise complementary curves so that the elements fit with each other.

This summary is provided to introduce concepts in simplified form that are further described below in the Detailed Description. This summary is not intended to identify key features or essential features of the disclosed or claimed subject matter and is not intended to describe each disclosed embodiment or every implementation of the disclosed or claimed subject matter. Specifically, features disclosed herein with respect to one embodiment may be equally applicable to another. Further, this summary is not intended to be used as an aid in determining the scope of the claimed subject matter.

Many other novel advantages, features, and relationships will become apparent as this description proceeds. The figures and the description that follow more particularly exemplify illustrative embodiments.

BRIEF DESCRIPTION OF THE DRAWINGS

The disclosed subject matter will be further explained with reference to the attached figures, wherein like structure or system elements are referred to by like reference numerals throughout the several views.

While the above-identified figures set forth one or more embodiments of the disclosed subject matter, other embodiments are also contemplated, as noted in the disclosure. In all cases, this disclosure presents the disclosed subject matter by way of representation and not limitation. It should be understood that numerous other modifications and embodiments can be devised by those skilled in the art which fall within the scope and spirit of the principles of this disclosure.

The figures may not be drawn to scale. In particular, some features may be enlarged relative to other features for clarity. Moreover, where terms such as above, below, over, under, top, bottom, side, right, left, etc., are used, it is to be understood that they are used only for ease of understanding the description. It is contemplated that structures may be oriented otherwise.

DETAILED DESCRIPTION

This disclosure is directed to a portable miniature golf game in which the playing surface and game components are scaled to be used on a tabletop or similarly sized area. Moreover, unlike a traditional miniature golf course wherein each course or hole is permanently arranged so that it takes up valuable space even when not in play, the game components of the disclosed apparatus are reconfigurably arranged on the playing surface, so different courses or holes can be constructed serially on a single playing surface, thereby leading to very efficient use of space. Moreover, the game components may be arranged and rearranged in nearly unlimited manners on the playing surface to construct new courses, thereby allowing the players to impose new, surprising, and fun challenges with each construction.

Figure 1:
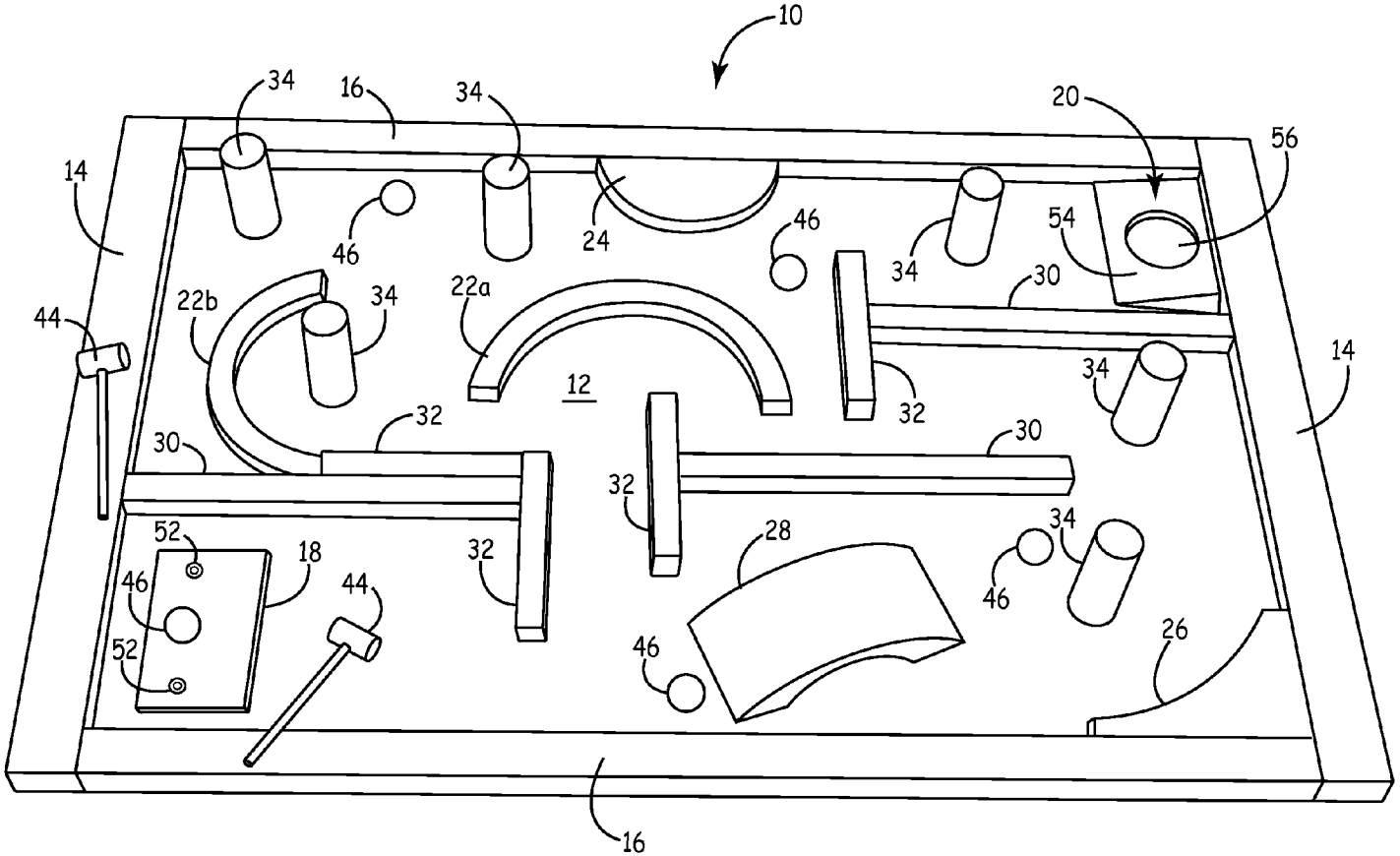
FIG. 1 is a top perspective view of an exemplary game apparatus as it might be set up during a game.

FIG. 1 shows game apparatus 10 arranged during an exemplary game. Apparatus 10 includes a flexible rectangular playing surface 12 bounded by raised opposite first and second end rails 14 and raised opposite first and second side rails 16. One or more players constructs a course or "hole" on playing surface 12 by arranging a selected set of variously shaped course components, including tee zone 18, ball receptacle 20, large arch 22*a*, small arch 22*b*, semi-circle 24, corners 26, bridge 28, long rails 30, medium rails 32, and tall pegs 34. Other available course construction components shown in FIG. 2 include stream 36, ramps 38, short rails 40 and short pegs 42. Once selected the game components 18-42 are arranged on playing surface 12, one or more players uses a mallet 44 to maneuver the player's ball 46 from tee zone 18 to ball receptacle 20.

Figure 2:
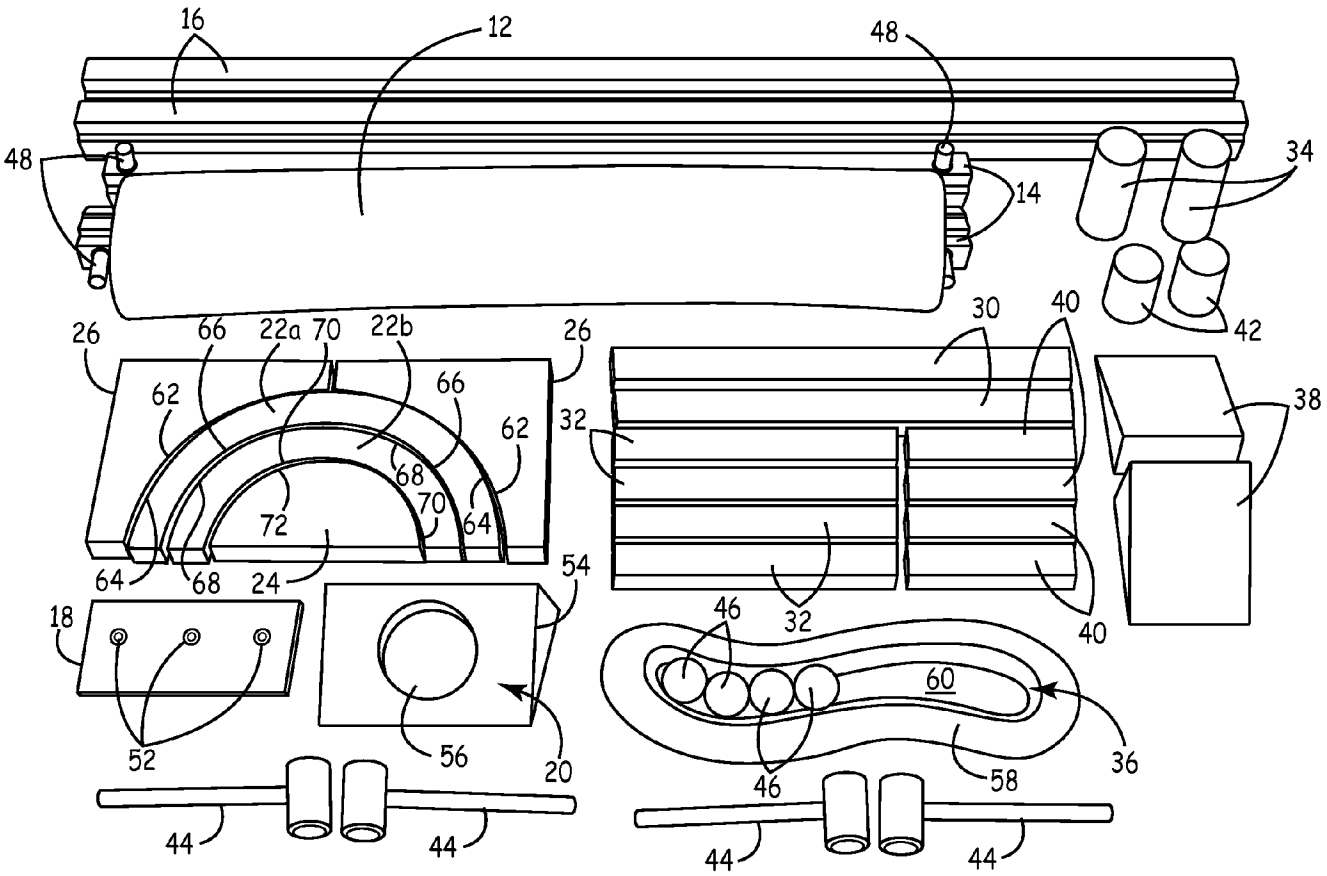
FIG. 2 is a top perspective view of components of an exemplary game apparatus.
Figure 3:
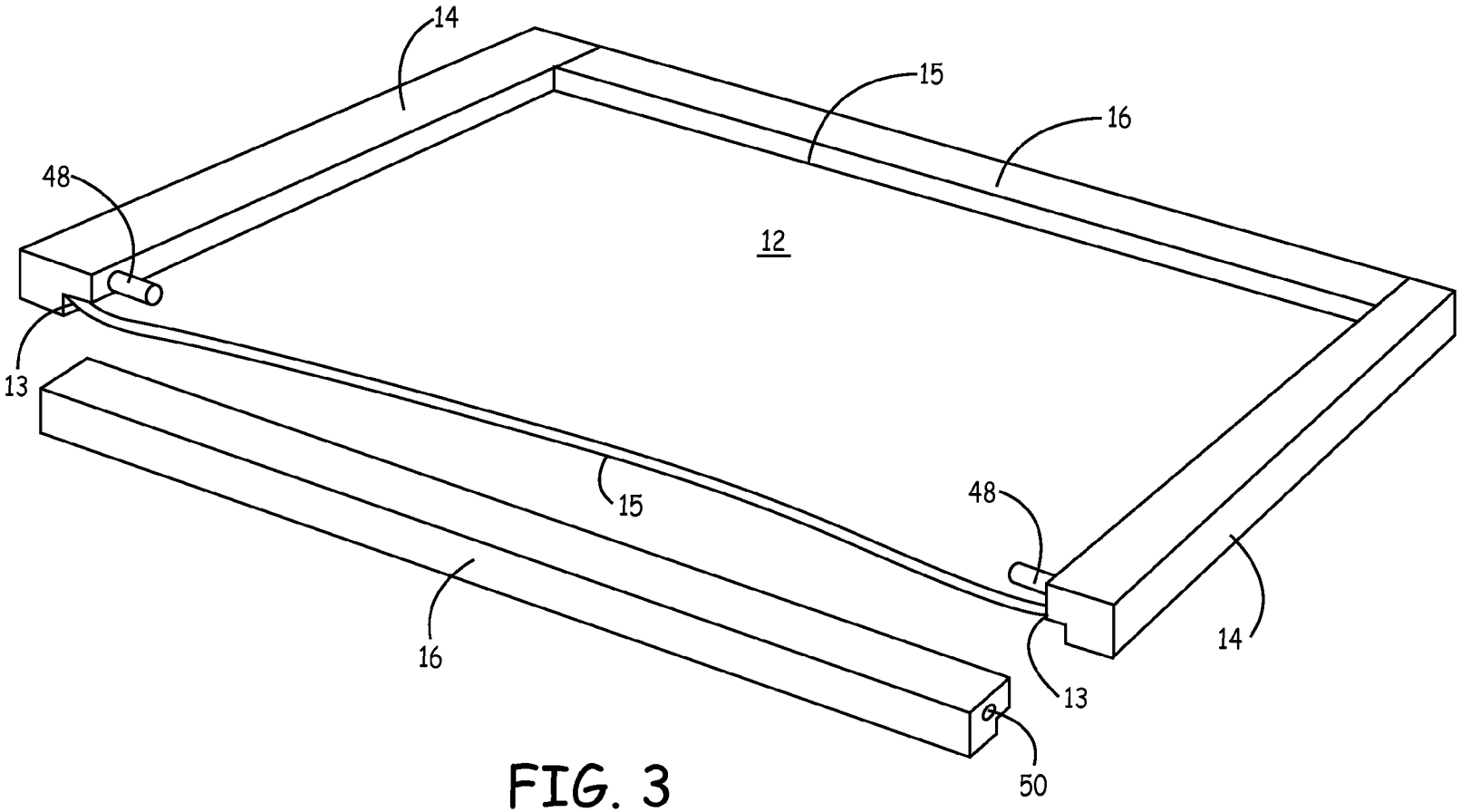
FIG. 3 is a top perspective view of assembly of an exemplary playing surface of the game apparatus of FIGS. 1 and 2.

As shown in FIG. 3, in an exemplary embodiment, playing surface 12 is provided with its first and second opposite end edges 13 attached to end rails 14 (such as by the use of adhesive or mechanical fasteners, for example). As shown in FIG. 2, playing surface 12 is rolled about one of the end rails 14 for a compact presentation for storage or transport. Each end rail 14 includes dowel pins 48 disposed proximate opposite ends of the end rail 14 that align with bores 50 in opposite ends of side rails 16. After unrolling playing surface 12, side rails 16 are removably attached proximate first and second opposite side edges 15 of playing surface 12 by inserting dowel pins 48 into bores 50 in each end of each side rail 16. While one suitable construction is shown and described, it is to be understood that the mechanical parts may be otherwise provided; for example, pins may be positioned on side rails 16 and complementary bores on end rails 14. Moreover, other temporary attachment mechanisms known in the art may also be used, such as hook and loop fasteners, latches, dovetail and other common joints, and magnets, for example.

In an exemplary embodiment, playing surface 12 has sufficient elasticity to allow for such assembly while presenting a smooth playing surface 12 once assembled. In an exemplary embodiment, playing surface 12 is constructed from a mat material in green to resemble a grass surface. One such material, for example, is available from RPM, Inc. of Savage, Minn. under the trademark DRYMATE®. Desirable properties of playing surface 12 include durability, edges that do not fray, flexibility for rolling, and the propensity to lay flat after being rolled or folded for an extensive period of time, for example.

Once assembled as shown in FIG. 3, end rails 14 and side rails 16 form a raised perimeter border that surrounds rectangular playing surface 12. Because end edges 13 of playing surface 12 are permanently attached to end rails 14, when assembled, playing surface does not slip or shift with respect to the border formed by end rails 14 and side rails 16. In an exemplary embodiment, end rails 14, side rails 16, tee zone 18, ball receptacle 20, large arch 22*a*, small arch 22*b*, semicircle 24, corners 26, bridge 28, long rails 30, medium rails 32, tall pegs 34, ramps 38, short rails 40, short pegs 42, mallets 44 and balls 46 are constructed of wood or similar material.

In an exemplary embodiment, no fastening mechanism is required between the course construction elements 18-42 and playing surface 12. In such an embodiment, each of the course construction elements is of sufficient weight and has a suitable surface to be retained upon playing surface 12 so as to not be dislodged by the action of balls 46 against the course construction elements 18-42. In one embodiment, an anti-slip coating may be provided on a surface of each of the course construction elements 18-42.

In an exemplary embodiment, tee zone 18 includes a plurality of spaced depressions 52 in which a ball 46 may rest for initial placement at the beginning of play. Ball receptacle 20 includes an inclined upper surface 54 and a relatively large and deep hole 56 into which a ball 46 may drop and be retained. Each of balls 46 may be differently colored or patterned or may be otherwise be visually differentiable so that each player can easily identify and track his or her own ball. Stream 36 simulates a water hazard; it has a curvilinear shape with an elongated central valley 60 surrounded by an inclined rim 58.

Large arch 22*a*, small arch 22*b*, semicircle 24 and corners 26 are sized in an exemplary embodiment with complementary curves so that they can be formed from a rectangular piece of material, as shown in FIG. 2. Specifically, each of two corners 26 has a quarter-circle cut-out 62 sized to fit against the larger curve 64 of large arch 22*a*. A smaller curve 66 of large arch 22*a* is sized to fit around the larger curve 68 of small arch 22*b*. A smaller curve 70 of small arch 22*b* is sized to fit around the curve 72 of semicircle 24. In an exemplary embodiment, a length of a long rail 30 is equal to a length of a medium rail 32 added to a length of a short rail 40. Moreover, each of the pieces 22*a*, 22*b*, 24, 26, 30, 32 and 40 has the same thickness. These features lead to efficiency in manufacturing; materials savings; the ability to compactly and neatly package the pieces; and flexibility in play, as different pieces easily fit together in a variety of configurations. The illustrated and described game components are exemplary and numerous modifications and alternatives are possible.

During play, one or more players uses a mallet 44 to propel a ball 46 through a course constructed on playing surface 12. Such a course starts at tee zone 18, ends at ball receptacle 20, and may include any or all of the other course construction elements 22*a*-42. Other course construction components can also be used. The course construction elements 22*a*-42 can be arranged on playing surface 12 within raised perimeter formed by end rails 14 and side rails 16 in any fashion desired by the players. In an exemplary game, a first player designs a first course or hole using whichever of the course construction elements 22*a*-42 he prefers in any arrangement that he likes. Once all of the players have successfully navigated their respective ball 46 from tee zone 18 to ball receptacle 20, another player may design a new course by reconfiguring any or all of the course construction elements 22*a*-42 as desired, as well as altering the location and orientations of the tee zone 18 and ball receptacle 20. Entertainment value is thus obtained by not only maneuvering a ball 46 through the course, but also in designing a unique course for each hole.

In a basic game, a course or hole is constructed from tee zone 18, ball receptacle 20, and course construction elements 22*a*-42 by one or more players. The players start from the tee zone 18 in turn, each player taking a first shot with his respective ball 46 and mallet 44. Then, the player whose ball 46 is farthest from the ball receptacle 20 takes the next shot. The player the second farthest from the ball receptacle 20 takes the following shot, etc. (like traditional golf play rules). Play continues until a player sinks his ball 46 into ball receptacle 20. The first player to sink his ball 46 into ball receptacle 20 wins the hole. If a player's ball 46 jumps the raised perimeter formed by end rails 14 and side rails 16, the player is out of the game for that hole. The winner of the hole constructs the next hole by reconfiguring any or all of the course construction elements 22*a*-42 as desired, along with tee zone 18 and ball receptacle 20.

In an advanced game, a course or hole is constructed from course construction elements 22*a*-42 by one or more players. Each player plays the hole by himself and counts the number of shots required to put his ball 46 into ball receptacle 20. If a player's ball 46 jumps the raised perimeter, the player must return his ball to the tee zone 18 and continue playing, thereby adding to the total number of shots taken. The player who sinks his ball 46 into the ball receptacle 20 using the fewest number of shots wins.

After play, game apparatus 10 may be disassembled by disconnecting bores 50 of side rails 16 from pins 48 of end rails 14. Then playing surface 12 may be rolled or folded upon one or both of end rails 14 for portability.

In the foregoing description, the disclosed game has been described with reference to an embodiment comprising tangible, physical pieces. However, the methods of playing a game according to the present disclosure in all embodiments disclosed above and their equivalents may also be played in virtual or digital environment on equipment such as a video gaming machine, a personal or handheld computer, or on any other machine (e.g., personal digital assistant (PDA), cell phone, etc.) capable of simulating a ball rolling among obstacles.

The virtual games can operate in known operating system environments such as Windows, Windows Mobile, Apple, Droid, Unix operating environments, PDA operating environments, video game consoles and other known operating environments. Input entries from players can include audio, device movement or user movement detection, keystrokes, touch screen entry, mouse, stylus and other pointing device entry. Outputs can be displayed to the player on known video displays.

In an exemplary embodiment, one or more players interacts with the game via a graphical user interface such as a computer monitor in conjunction with an input device. The game is presented to the players, who can input information such as the type of game desired, the number of players and optionally information such as their names or avatars. A playing area (e.g., rectangular) is presented to the player(s), along with a finite set of course construction elements. The game can be programmed to allow the player to configure a course or hole within the playing area, using any or all of the course construction elements, in two or three dimensions. In one embodiment, the player constructs the course using a computer mouse by clicking on a course construction element, dragging the element to the desired location and orientation on the playing area, and clicking again to release the course construction element. In an exemplary embodiment, the player is presented with options to rotate the element. If construction in three dimensions is permitted, the player is also presented with an option to rotate or otherwise maneuver each element in a direction orthogonal to the playing area. In an exemplary embodiment, the player enters a command or clicks a button to signal that course construction is complete. Software checks for implementation of required elements such as a tee zone and a ball receptacle and alerts the player if correction is needed.

Each player is accorded a ball, which he propels or otherwise causes to move by a command received through an interface such as device movement or user movement detection, or via a computer mouse, joystick, or touch-screen entry. The virtual balls can be colored or labeled to help a player keep track of his respective ball. The balls travel along or bounce off the course construction elements in a manner that would be expected according to the laws of physics. Scores are automatically computed by software in accordance with the type of game selected by the player(s). The virtual game can be played in accordance with the instructions set forth above. Moreover, the virtual game can be programmed to allow for other forms of play.

Although the subject of this disclosure has been described with reference to several embodiments, workers skilled in the art will recognize that changes may be made in form and detail without departing from the spirit and scope of the disclosure. In addition, any feature disclosed with respect to one embodiment may be incorporated in another embodiment, and vice-versa.

What is claimed is:

1. An apparatus comprising:

first and second end rails;

a flexible, elastic, rectangular playing surface having first and second opposite end edges and first and second opposite side edges, wherein the first end edge of the surface is permanently connected to the first end rail, and wherein the second end edge of the surface is permanently connected to the second end rail;

a first side rail configured for removable attachment to the first and second end rails proximate the first side edge of the playing surface;

a second side rail configured for removable attachment to the first and second end rails proximate the second side edge of the playing surface;

a dowel disposed proximate opposite ends of each end rail; and a bore disposed on opposite ends of each side rail to accept one of the dowels.

2. An apparatus comprising:

first and second end rails;

a flexible, elastic, rectangular playing surface having first and second opposite end edges and first and second opposite side edges, wherein the first end edge of the surface is permanently connected to the first end rail, and wherein the second end edge of the surface is permanently connected to the second end rail;

a first side rail configured for removable attachment to the first and second end rails proximate the first side edge of the playing surface;

a second side rail configured for removable attachment to the first and second end rails proximate the second side edge of the playing surface; and plurality of golf course constructions elements, wherein the plurality of golf course construction elements comprises:

a semicircle; and a first arch sized to fit around the semicircle.

3. The apparatus of claim 2 further comprising a second arch sized to fit around the first arch.

4. The apparatus of claim 3 further comprising two corner pieces, each corner piece having a quarter-circle cut-out, wherein each of the two corner pieces is sized to fit against half of the second arch.

5. The apparatus of claim 4 wherein the semicircle, first arch, second arch and two corner pieces each have a substantially identical thickness and are sized to fit together to form a rectangle.

6. An apparatus of comprising:

first and second end rails;

a flexible, elastic, rectangular playing surface having first and second opposite end edges and first and second opposite side edges, wherein the first end edge of the surface is permanently connected to the first end rail, and wherein the second end edge of the surface is permanently connected to the second end rail;

a first side rail configured for removable attachment to the first and second end rails proximate the first side edge of the playing surface;

a second side rail configured for removable attachment to the first and second end rails proximate the second side edge of the playing surface; and a plurality of golf course constructions elements, wherein the plurality of golf course construction elements comprises:

a short rail;

a medium rail; and a long rail;

wherein a length of the long rail is equal to a length of the short rail plus a length of the medium rail.

7. An apparatus comprising:

first and second end rails;

a flexible, elastic, rectangular playing surface having first and second opposite end edges and first and second opposite side edges, wherein the first end edge of the surface is permanently connected to the first end rail, and wherein the second end edge of the surface is permanently connected to the second end rail;

a first side rail configured for removable attachment to the first and second end rails proximate the first side edge of the playing surface;

a second side rail configured for removable attachment to the first and second end rails proximate the second side edge of the playing surface; and plurality of golf course constructions elements, wherein the plurality of golf course construction elements comprises a curvilinear hazard having an elongated valley surrounded by an inclined rim.

8. A method comprising:

unrolling a flexible, elastic, rectangular playing surface from at least one of a first and second end rail to form a flat rectangular playing surface, wherein the flexible rectangular playing surface has first and second opposite end edges and first and second opposite side edges, wherein the first end edge of the surface is permanently connected to the first end rail, and wherein the second end edge of the surface is permanently connected to the second end rail;

stretching the playing surface and attaching a first side rail to the first and second end rails proximate the first side edge of the playing surface; and stretching the playing surface and attaching a second side rail to the first and second end rails proximate the second side edge of the playing surface.

9. The method of claim 8 wherein:

attaching the first side rail to the first and second end rails comprises inserting a dowel of each of the first and second end rails into a bore in each of two ends of the first side rail; and attaching the second side rail to the first and second end rails comprises inserting a dowel of each of first and second end rails into a bore in each of two ends of the second side rail.

10. The method of claim 8 further comprising placing a plurality of golf course construction elements on the playing surface to form a course, wherein the elements comprise at least a tee zone and a ball receptacle.

11. The method of claim 10 further comprising moving a ball through the course, starting at the tee zone and ending at the ball receptacle.

12. The method of claim 11 further comprising repositioning at least some of the plurality of golf course construction elements on the playing surface after moving the ball through the course.

* * * * *